US006035441A

United States Patent [19]

Mellon et al.

[11] Patent Number: 6,035,441

[45] **Date of Patent: *Mar. 14, 2000**

[54] GARMENT CUFF WITH A THUMB OPENING

[76] Inventors: Charles B. Mellon, 2733 Mitchell Ave., Clovis, Calif. 93611; Mark A. Mellon, 30250 Horshoe Dr., Coarsegold, Calif. 93614

[ * ] Notice: This patent is subject to a terminal disclaimer.

[21] Appl. No.: 09/122,238

[22] Filed: Jul. 24, 1998

Related U.S. Application Data

[63] Continuation of application No. 08/887,736, Jul. 3, 1997, Pat. No. 5,784,720, which is a continuation of application No. 08/741,347, Oct. 29, 1996, abandoned, which is a continuation of application No. 08/444,398, May 19, 1995, abandoned.

[51] Int. Cl.[7] ..... A41B 7/00; A41D 19/00

[52] U.S. Cl. ..... 2/125; 2/123; 2/159; 2/162; 2/60

[58] Field of Search ..... 2/123, 59, 60, 2/125, 162, 170, 158, 159, 161.1, 161.6, 163, 270; D2/610, 614, 615, 616, 617, 858

[56] References Cited

U.S. PATENT DOCUMENTS

| | | |
|---|---|---|
| Re. 7,759 | 6/1877 | Silva . |
| 1,092,047 | 3/1914 | Hertz . |
| 1,296,966 | 3/1919 | Kaufman . |
| 1,328,545 | 1/1920 | O'Shea . |
| 2,675,554 | 4/1954 | Gertz . |
| 2,836,828 | 6/1958 | Henrikson . |
| 3,329,972 | 7/1967 | Schwab . |
| 4,297,746 | 11/1981 | Zarbos . |
| 4,359,784 | 11/1982 | Harrington . |
| 4,475,253 | 10/1984 | Laveckis . |
| 4,559,647 | 12/1985 | Smith et al. . |
| 4,756,027 | 7/1988 | Buenos . |
| 4,773,100 | 9/1988 | Kuo . |
| 5,117,507 | 6/1992 | Long . |
| 5,125,117 | 6/1992 | Buenos . |
| 5,138,717 | 8/1992 | Tolton . |
| 5,308,275 | 5/1994 | Kornbleuth . |
| 5,357,633 | 10/1994 | Rael . |

*Primary Examiner*—John J. Calvert
*Assistant Examiner*—Shirra L. Jenkins
*Attorney, Agent, or Firm*—Martin & Ferraro, LLP

[57] ABSTRACT

A garment having a cuff construction with an opening for permitting the thumb of the wearer and the fingers to extend outside the sleeve. The cuff is generally integrally attached to an article of clothing, and folds in on itself for storing the cuff permitting the use or non use of the cuff at the user's direction. The cuff is formed at an opening of a sleeve in a garment, and includes a tubular member which is switchable between a first rolled position allowing the hand to pass through and a second unrolled position forming a covering around at least a portion of the hand and/or thumb while leaving the ends of the fingers and thumb exposed.

18 Claims, 3 Drawing Sheets

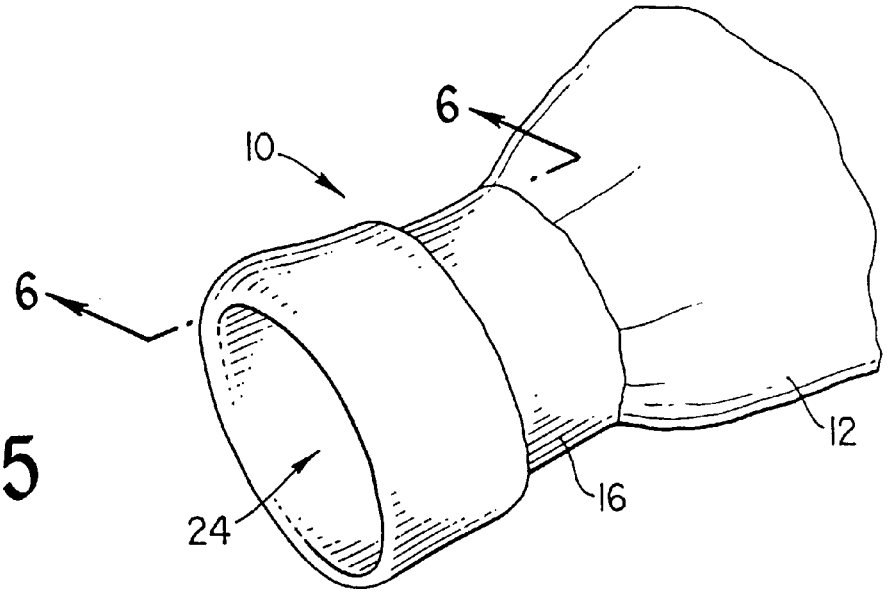
FIG. 5
FIG. 6
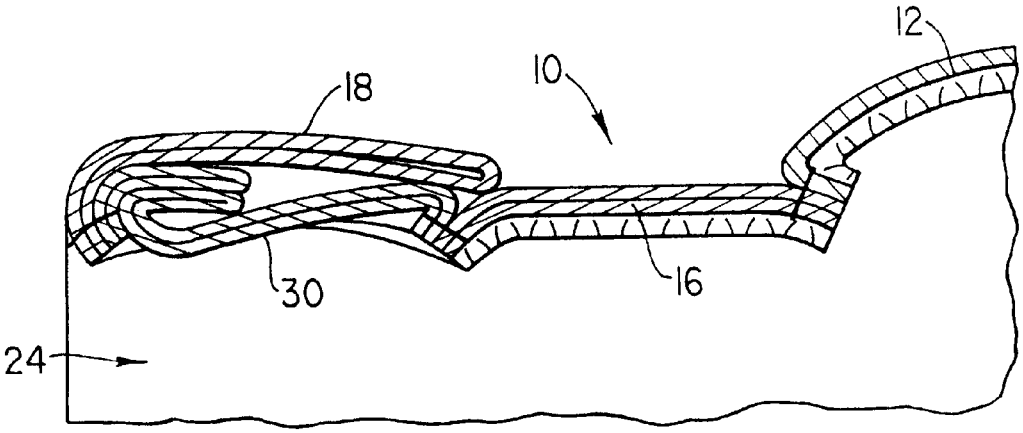

GARMENT CUFF WITH A THUMB OPENING

This application is a continuation of Ser. No. 08/887,736 filed Jul. 3, 1997 U.S. Pat. No. 5,784,720, which is a continuation of Ser. No. 08/741,347 filed Oct. 28, 1996, abandoned, which is a continuation of Ser. No. 08/444,398 filed May 19, 1995, abandoned.

BACKGROUND OF THE INVENTION

1. Field of the Invention

The present invention relates in general to cuff constructions, and in particular to cuff constructions for garments and the like which provide an opening for the thumb of the wearer to extend outside the cuff.

2. Description of the Related Art

Cuffs are well known in the art of clothing manufacture. Almost every article of clothing has a cuff of some sort at the opening through which a person's hand is extended. These cuffs come in many forms, such as button closing cuffs and elastic band closing cuff, but the main function of these cuffs is merely to seal the clothing around the arm of the wearer and not to cover the hands. Thus, people would commonly pull the sleeves of the garment over the hand to provide a makeshift covering to protect the hands. This would distort the garment and make the hands unavailable to perform a variety of tasks.

In the past various modified cuffs have been devised.

For example, U.S. Pat. No. 4,756,027 issued to Buenos et al. on Jul. 12, 1988 and U.S. Pat. No. 5,125,117 issued to Buenos et al. on Jun. 30, 1992 disclose a cuff construction with a panel for entirely covering the finger and thumb of the hand like a mitten.

U.S. Pat. No. 4,359,784 issued to Harrington on Nov. 23, 1982 discloses a sleeve-mitten combination for enclosing the entire hand, fingers and thumb of the wearer in a tubular structure formed at the end of a sleeve.

U.S. Pat. No. 5,138,717 issued to Tolton on Aug. 18, 1992 discloses an athletic garment having a "piston and cylinder" cuff arrangement to furnish the wearer with an extra five to six inches of cuff extension without having the sleeve ride-up the arm of the wearer. The sleeve arrangement does not cover any portion of the hand of the wearer.

However, none of the cuffs of the past provide protection to the hands and which permits the wearer to retain a normal sense of touch and full use of the hand. It would be advantageous if a cuff provided a covering for the hands of the wearer that allows at least a portion of the thumb and/or the fingers to be exposed so that the wearer's sense of touch is not unimpeded by the presence of a hand covering.

Accordingly, it is desirable to provide a cuff construction for covering at least a portion of the hand which provides the additional function of providing an opening for the thumb and/or the fingers of the wearer to extend to the outside of the cuff, that conveniently stored within the cuff and out of the way when not in use.

SUMMARY OF THE INVENTION

The present invention is directed to a cuff for a garment sleeve having an improved construction for providing a covering for the hand which allows at least a portion of the fingers to be exposed to the exterior of the cuff and at least one readily accessible opening permitting at least a portion of the thumb to extend outside the cuff. The cuff construction of the present invention allows the wearer's sense of touch in the fingers and thumb to remain unimpeded by the cuff such that the ability to conduct athletic and other activities with the hand for which dexterity and the sense of touch are important are not impaired.

In the preferred embodiment, the cuff construction of the present invention comprises a tubular member having a side wall and one end secured to the distal end of a sleeve and which is capable of extending to at least the knuckle area of the hand where the fingers meet the hand of the wearer. The free end of the tubular member provides an opening for the fingers of the hand. The tubular member has a second opening in the side wall for the thumb to pass through. The thumb opening may be in communication with a thumb sheath secured to the tubular member at the second opening in the side wall. The thumb sheath covers at least a portion of the wearer's thumb and has a free end which allows at least a tip of the thumb to extend therethrough.

The tubular member is switchable from a first rolled position to a second unrolled position. In the first rolled position, the tubular member is folded back forming an opening through which the wearer's hand extends uncovered as in a normal cuff. In the second unrolled, or in use position, the tubular member is unfolded away from the sleeve, revealing the opening for the thumb and extending over the hand of the wearer to a position near the knuckle area of the hand. In this manner a substantial portion of the wearer's hand is covered and protected by the cuff and kept warm, while the thumb and the fingers of the hand remain exposed to the exterior of the cuff such that the sense of touch of the wearer is unimpeded and the full use of the hand is possible.

The cuff construction of the present invention may be incorporated in any long sleeved garments, such as but not limited to, sweatshirts, sweaters, coats, jackets, and the like. The cuff construction of the present invention may be made of an elastic ribbed material commonly used in the manufacturing of conventional cuffs or may be made of the same material as the garment in which the cuff is incorporated.

OBJECTS OF THE PRESENT INVENTION

It is an object of the invention to provide an improved cuff construction for a garment.

It is another object of the invention to provide an improved hand covering which does not impede the wearer's sense of touch at the fingers and thumb.

It is another object of the invention to provide an improved covering for the hands.

It is a further object of the invention to provide a cuff construction which includes a covering for a portion of the hands which is an integral part of the cuff.

It is still a further object of the invention to provide a garment construction including a covering for at least a portion of the wearer's hand, which is stored in the cuff of the garment.

It is yet another object of the invention is to provide a garment construction in which a hand covering is integrally formed with the garment cuff.

These and other objects of the present invention will become apparent from a review of the accompanying drawings and the detailed description of the drawings.

BRIEF DESCRIPTION OF THE DRAWINGS

FIG. 5 is an enlarged fragmentary view of a portion of a sleeve with the cuff of the present invention shown in the rolled position.

FIG. 6 is an enlarged sectional view along line 6—6 of FIG. 5 of the cuff of the present invention shown in the rolled position.

DETAILED DESCRIPTION OF THE DRAWINGS

Referring generally to FIGS. 1–4, a cuff construction arranged in accordance with the present invention is shown as part of a long sleeve garment G such as a sweatshirt, sweater or similar garment. The cuff of the present invention, generally referred to by the numeral 10, is formed at the end of one or both of the long sleeves 12 of the garment G.

Figure 3:
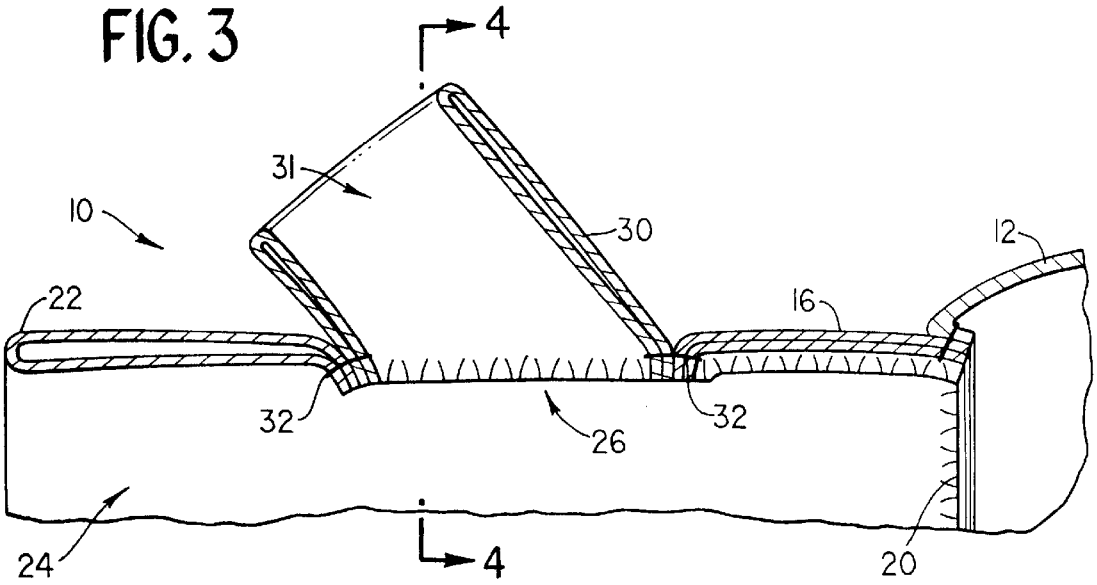
FIG. 3 is an enlarged sectional view along line 3—3 of FIG. 2 of the thumb portion of the cuff of the present invention.
Figure 4:
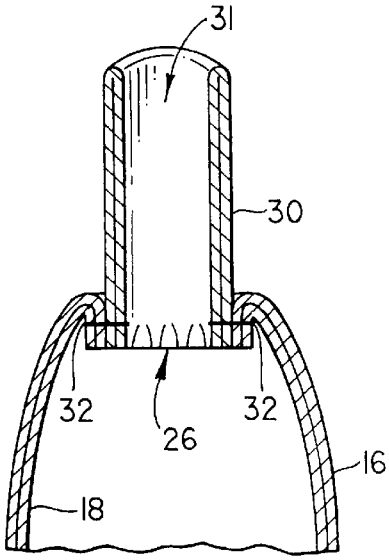
FIG. 4 is a sectional view along line 4—4 of FIG. 3 of the cuff of the present invention.

Referring specifically to FIGS. 3 and 4, a cross sectional view of the cuff 10 is shown in its unrolled position.

The cuff 10 comprises a tubular member 16 having side wall 18, a proximal end 20 secured to the end of sleeve 12, and a distal end 22 having an opening 24 coaxial to the longitudinal axis of sleeve 12 for the hand of the wearer to pass through. The side wall 18 of the tubular member 16 has a hole 26 radial to the longitudinal axis of sleeve 12 corresponding in location with the base of the thumb of the wearer's hand. The hole 26 is of sufficient size to allow the thumb to extend from the interior of the tubular member 16 through the opening 26 to the exterior of the cuff 10. In the preferred embodiment of the present invention, the cuff 10 has a thumb sheath 30 for covering the thumb that is in communication with the interior space of the tubular member 16 by means of the hole 26. In the preferred embodiment of the present invention, the thumb sheath 30 covers at least a portion of the wearer's thumb and has an opening 31 which allows for at least the tip of the thumb to be exposed to the exterior of the cuff 10. The thumb sheath 30 may be secured to the tubular member 16 near the hole 26 by stitching 32 or the thumb sheath 30 may formed as an integral part of the cuff 10 similar to the thumb portion of a mitten.

Figure 1:
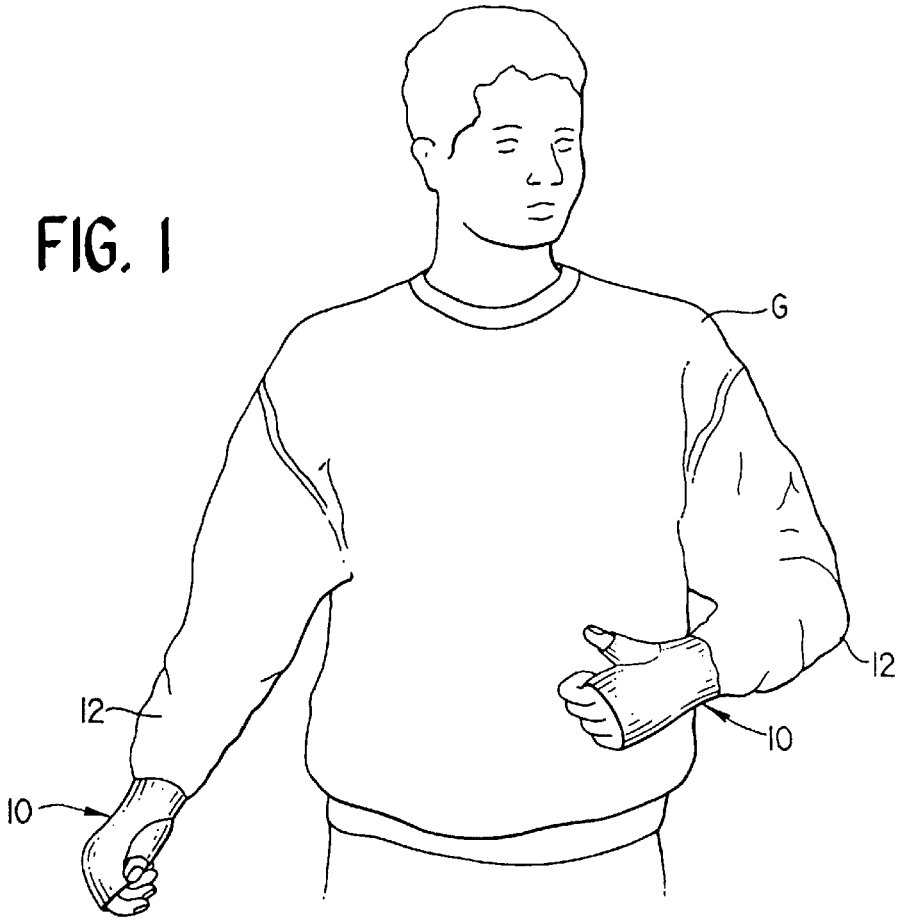
FIG. 1 is a front elevational view of a person wearing a garment including the cuff of the present invention.
Figure 2:
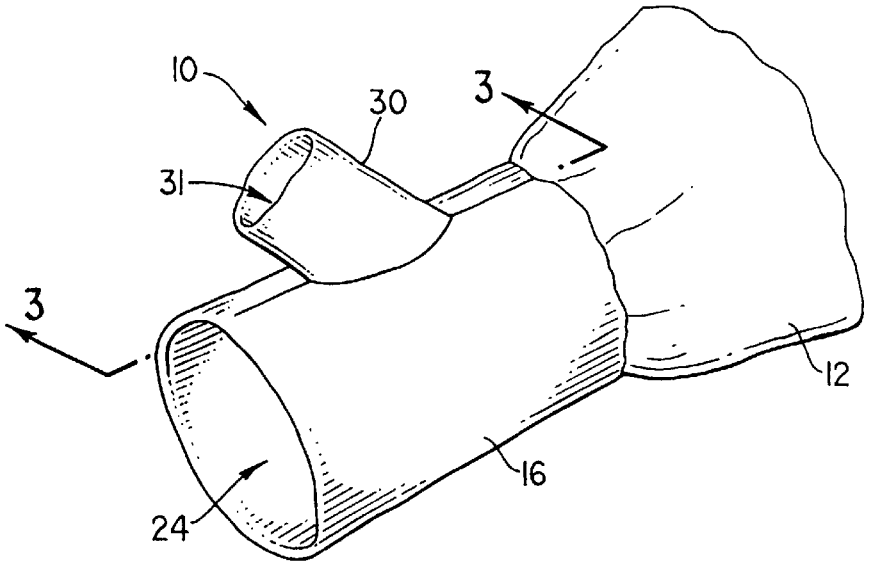
FIG. 2 is an enlarged fragmentary view of a portion of a sleeve with the cuff of the present invention shown in an unrolled position.

Referring to FIGS. 1 and 2, a cuff 10 is shown in the unrolled position to form a covering for at least a portion of the wearer's hand. The distal end 22 of tubular member 16 extends just past the knuckles of the hand in the area where the fingers meet the hand. The wearer's thumb is inserted in the thumb sheath 30 and is partially exposed to the exterior of the cuff 10. The overall effect is that a partial hand covering is formed at the end of each sleeve 12 with at least a portion of the wearer's fingers and the thumb being exposed to the exterior of the cuff 10 so that the wearer's dexterity and sense of touch are unimpeded.

The structure of the cuff 10 permits fingers of the wearer's hand to extend to the exterior of the cuff 10 through the opening 24 at the distal end 22 of the tubular member 16 and permits the thumb to extend through the thumb sheath 30 to the exterior of the cuff 10. As a result, the dexterity and tactile senses of the wearer's hand are unimpeded as it is possible for the wearer to use the thumb with the remaining fingers of the hand and feel any article being handled. The cuff 10 covers a substantial portion of the wearer's hand including at least a portion of the wearer's thumb and provides a shield against cold weather and wind. As a result of the structure of cuff 10 of the present invention, the hand is kept protected and warm while dexterity and the tactile senses are preserved.

Referring to FIGS. 5 and 6, when it is not desirable to use the cuff 10 as a hand covering, the cuff 10 may be stored at the end of the sleeve 12. As shown in FIG. 6, the cuff 10 is stored in the rolled position by folding the tubular member 16 back over itself toward the sleeve 12 to create at least one fold. The thumb sheath 30 is stored between the fold of the tubular member 16 created when the tubular member 16 is rolled. The wearer's hand slides through opening 24 in the distal end of cuff 10 as it would with a conventional cuff. In this manner, when the cuff 10 is not being used as a hand covering, the thumb sheath 30 is hidden and stored within the fold of the cuff 10 and the cuff 10 has an appearance identical to that of a conventional cuff. Further, it is appreciated that the cuff 10 may be rolled more than once as desired by the wearer.

In the preferred embodiment of the cuff 10, when the cuff 10 is in the unrolled position, the cuff 10 extends approximately 4 to 6 inches down the hand; the thumb sheath 30 is located approximately 2 inches below the area where the cuff 10 and the sleeve 12 meet. The thumb sheath 30 in the preferred embodiment has a length capable of covering approximately ¾ of the thumb of the user exposing the tip of the thumb to the exterior of the cuff 10.

While in this embodiment the garment G is a sweatshirt, it is within the scope of the present invention to utilize the cuff construction on a wide variety of garments. The garment G may be made of a conventional wool or acrylic material or the like. If the garment is a shirt or jacket, it may be constructed of natural fiber, such as cotton, or synthetic materials, such as nylon or polyester. The cuff 10 may be made of a cotton ribbed material or any other suitable material.

The advantages and conveniences provided by the cuff construction of the present invention make it particularly useful for a wide variety of uses. For example, a child's or infant's sweater fabricated with the cuff construction can instantly provide a hand covering to keep the wearer's hand warm. Similarly, a hunter or hiker suddenly overcome by a cold wind can instantly cover the hands. An athlete seeking hand warmth will be able to unroll the cuff to cover the hands while the thumb and fingers remain in full use and the wearer's sense of touch is not impaired. In all cases, the cuff of the present invention is part of the garment so that there is no need to stop an activity and search for mittens or gloves.

While the present invention has been described in detail with regards to the preferred embodiments, it is appreciated that other variations of the present invention may be devised which do not depart from the inventive concept of the present invention. In particular, it is appreciated that the various teachings described in regards to the specific embodiments herein may be combined in a variety of ways such that the features are not limited to the specific embodiments described above.

What is claimed is:

1. A garment comprising at least one sleeve having an interior surface, an exterior surface, and an end proximate the hand of the wearer, said end comprising a foldable cuff for surrounding at least a portion of the wearer's wrist, said cuff having a finger opening for permitting the fingers of the wearer to extend from said interior surface to said exterior surface of said sleeve and a thumb opening for permitting the thumb of the wearer to extend from said interior surface to said exterior surface of said sleeve, at least a portion of said cuff covering said thumb opening when folded and at least a portion of said cuff covering the back of the wearer's hand when unfolded to form a partial hand covering.

2. The garment of claim 1, wherein said thumb opening has an extended tubular portion open at its opposite end.

3. The garment of claim 1, further comprising a tubular sheath surrounding said thumb opening, said tubular sheath covering at least a portion of the thumb of the wearer.

4. The garment of claim 3, wherein said tubular sheath extends away from said interior surface of the sleeve.

5. The garment of claim 1, wherein said cuff is folded to give the end of said sleeve a conventional appearance.

6. The garment of claim 2, wherein said extended tubular portion is stored within a portion of said folded cuff to give the end of said sleeve a conventional appearance.

7. The garment of claim 3, wherein said tubular sheath is stored within a portion of said folded cuff to give the end of said sleeve a conventional appearance.

8. A garment comprising at least one sleeve having a longitudinal axis, an interior surface, an exterior surface, and an end proximate the hand of the wearer comprising a convertible cuff, said cuff having a finger opening coaxial to the longitudinal axis of said sleeve for permitting the fingers of the wearer to extend from said interior surface to said exterior surface, said cuff having a first position wherein said cuff is folded over a portion of said sleeve appearing as a conventional cuff on said sleeve and a second position wherein said cuff is fully unfolded to cover a portion of the user's hand, a portion of said cuff in said second position covering at least a portion of the back of the wearer's hand to form a partial hand covering, said cuff having a thumb opening radial to the longitudinal axis of said sleeve for permitting the thumb of the wearer to extend from said interior surface to said exterior surface of said sleeve.

9. The garment of claim 8, further comprising a tubular portion in communication with said thumb opening and extending away from said interior surface of said sleeve.

10. The garment of claim 8, wherein said thumb opening is covered when said cuff is in said first position to give the end of said sleeve a conventional appearance.

11. The garment of claim 9, wherein said thumb opening is covered when said cuff is in said first position and said tubular portion is stored within a portion of the folded cuff to give the end of said sleeve a conventional appearance.

12. A garment comprising a sleeve having a hand covering located at one end and a longitudinal axis, said hand covering having a first fully extended position wherein said hand covering extends from the end of said sleeve, and a second retracted position wherein said hand covering is at least partially retracted from the end of said sleeve, said hand covering having a finger opening coaxial to the longitudinal axis of said sleeve for permitting the fingers of the wearer to extend from within said sleeve to an exterior of said hand covering, said hand covering when in said first position covers a portion of the wearer's hand such that the wearer's dexterity and sense of touch are unimpeded by said hand covering, said hand covering when in said second position providing a conventional appearance to said sleeve, and said hand covering having a thumb opening radial to the longitudinal axis of said sleeve for permitting the thumb of the wearer to extend from within said sleeve to said exterior of said hand covering.

13. The garment of claim 12, wherein said thumb opening is covered by said hand covering when said hand covering is in said second retracted position.

14. The garment of claim 12, farther comprising a tubular portion in communication with said thumb opening.

15. The garment of claim 12, wherein said garment is selected from one of a sweatshirt, sweater, jacket, and coat.

16. A garment comprising at least one sleeve having an interior surface, an exterior surface, and an end proximate the hand of the wearer comprising a convertible cuff said cuff having a finger opening for permitting the fingers of the wearer to extend from said interior surface to said exterior surface, said cuff having a first position wherein said cuff is folded over a portion of said sleeve appearing as a conventional cuff on said sleeve and a second position wherein said cuff is fully unfolded to cover a portion of the user's hand, a portion of said cuff in said second position covering at least a portion of the back of the wearer's hand to form a partial band covering, said cuff having a thumb opening for permitting the thumb of the wearer to extend from said interior surface to said exterior surface of said sleeve, and a tubular portion in communication with said thumb opening and extending away from said interior surface of said sleeve.

17. A garment comprising a sleeve having a hand covering located at one end, said hand covering having a first fully extended position wherein said hand covering extends from the end of said sleeve, and a second retracted position wherein said hand covering is at least partially retracted from the end of said sleeve, said hand covering having a finger opening for permitting the fingers of the wearer to extend from within said sleeve to an exterior of said hand covering, said hand covering when in said first position covers a portion of the wearer's hand such that the wearer's dexterity and sense of touch are unimpeded by said hand covering, said hand covering when in said second position providing a conventional appearance to said sleeve, and said hand covering having a thumb opening for permitting the thumb of the wearer to extend from within said sleeve to said exterior of said hand covering, said thumb opening being covered by said hand covering when said hand covering is in said second retracted position.

18. The garment of claim 17, further comprising a tubular portion in communication with said thumb opening.

* * * * *